United States Patent [19]

Pomaville et al.

[11] Patent Number: 4,607,678

[45] Date of Patent: Aug. 26, 1986

[54] FLEXIBLE STRIP DOOR ASSEMBLIES

[75] Inventors: Ronald C. Pomaville; Jack Landane, both of Bay City, Mich.

[73] Assignee: Easy Handling Co., Inc., Burton, Mich.

[21] Appl. No.: 660,693

[22] Filed: Oct. 15, 1984

[51] Int. Cl.[4] ..... A47H 13/01; A47H 23/05

[52] U.S. Cl. ..... 160/332

[58] Field of Search ..... 160/332, 330, 19; 24/587

[56] References Cited

U.S. PATENT DOCUMENTS

| | | | |
|---|---|---|---|
| 2,495,870 | 1/1950 | Soukup | 24/587 |
| 4,086,950 | 5/1978 | Power | 160/332 |
| 4,165,778 | 8/1979 | Smith | 160/332 |
| 4,257,471 | 3/1981 | Thurman, Jr. | 160/332 |
| 4,289,190 | 9/1981 | Catan | 160/332 |
| 4,312,396 | 6/1982 | McKinnon et al. | 160/332 |

*Primary Examiner*—J. Franklin Foss
*Assistant Examiner*—Cherney S. Lieberman
*Attorney, Agent, or Firm*—Learman & McCulloch

[57] ABSTRACT

A penetrable flexible strip closure for covering an opening includes an extrusion secured across the upper end of the opening as a header. The extrusion provides a continuous open ended T slot and individual clamps for each strip extend through generally central openings in the strips, which overlap at their side edges, and have enlarged heads received in the enlarged portions of the T slots. Releasable securing members are provided on the shanks of the clamps, which extend out the reduced size slot portions of the T slot, to clamp the lapped upper ends of the flexible strips against a bearing portion provided on the extrusion.

3 Claims, 3 Drawing Figures

FLEXIBLE STRIP DOOR ASSEMBLIES

FIELD AND BACKGROUND OF THE INVENTION

This invention relates to penetrable doors or closures formed of a plurality of vertically hanging and laterally overlapping, preferably transparent, flexible strips of the type which are in common use today to cover openings such as door openings to provide an environmental barrier. Such door assemblies are useful to reduce heat or cold loss, to restrict the movement of air pollutants and even flying insects, and to isolate noisy machinery. They are used to provide temperature-controlled barriers between rooms, to cover openings for overhead craneways, to function as secondary doors on receiving and loading docks, as telephone enclosures, in car wash installations, as conveyor assembly line opening covers, and as storage area enclosures. Many diverse constructions have been proposed and are in use and among them are the constructions utilized in the following patents:

| | | | |
|---|---|---|---|
| 4,033,396 | Thomasset | 4,289,190 | Catan |
| 4,086,950 | Power | 4,340,106 | Van Horn, II |
| 4,095,642 | McKinnon et al | 4,384,606 | Johnston et al |
| 4,165,778 | Smith | 4,388,961 | Schaefer et al |
| 4,257,471 | Thurmond | | |

While providing a thermal barrier, and a closure which restricts the movement of air pollutants such as dirt, smoke, fumes, dust, drafts, and the like, a door of this type must be readily penetrable by a vehicle, person or product. In recent years, considerable attention has been directed to providing a construction which can be readily afforded by those parties or businesses which must utilize a closure of this character, and there is a real need for such a system.

SUMMARY OF THE INVENTION

One of the prime objects of the present invention is to provide a flexible strip closure assembly utilizing an extruded header which can be readily extruded of a light-weight material such as aluminum in standard inventory lengths, which then can be readily severed in the field to provide a strip-supporting header of the required length for a particular opening. Such a construction provides a versatility which will enable the same header configuration to be economically factory-produced and then easily fitted to the many different sizes of openings which, in practice, are to be fitted with a closure of this type.

A further object of the invention is to provide an extremely economically produced assembly in which the individual flexible strips are individually secured to a header at any desired location over the length of the header. In the present construction this is accomplished by providing a continuous T slot in the header which extends from one end to the other, and using an individual clamp for each strip which can be situated at any location within the length of the T slot to secure a single strip in the desired position. Such a construction permits a given number of strips to accommodate to particular size openings with greater or lesser degrees of edge overlap, either with a uniform lap or to provide a section in which the edges overlap in a particular area more than in other areas.

Still another object of the invention is to provide a clamp system for the strips which permits an individual, damaged strip to be readily replaced.

Still a further object of the invention is to provide a header having a flatted bearing surface against which the upper ends of the strips are releasably clamped to maintain reliable suspension of the strips in substantially a common plane in which the edges of the strips tend to abut in sealing relation, the bearing surface functioning as a backer surface to resist stresses applied to the strips which might otherwise cause them to misalign and be damaged.

In summary, the construction of the present system permits a ready installation of plastic strips and extrusions which can be fabricated in the factory, and provides an economical light-weight system in which strips are individually clamped so that they are not misaligned and damaged, yet can be easily unclamped and replaced.

Other objects and advantages of the invention will be pointed out specifically or will become apparent from the following description when it is considered in conjunction with the appended claims and the accompanying drawings.

IN THE DRAWINGS

Figure 1:
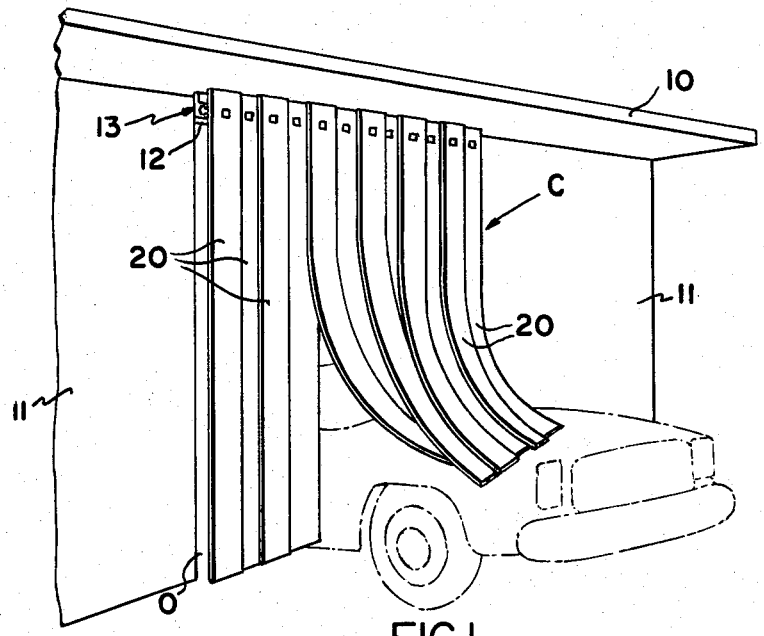
FIG. 1 is a perspective, front elevational view illustrating the manner in which flexible strip closure systems of the present type are employed.
Figure 2:
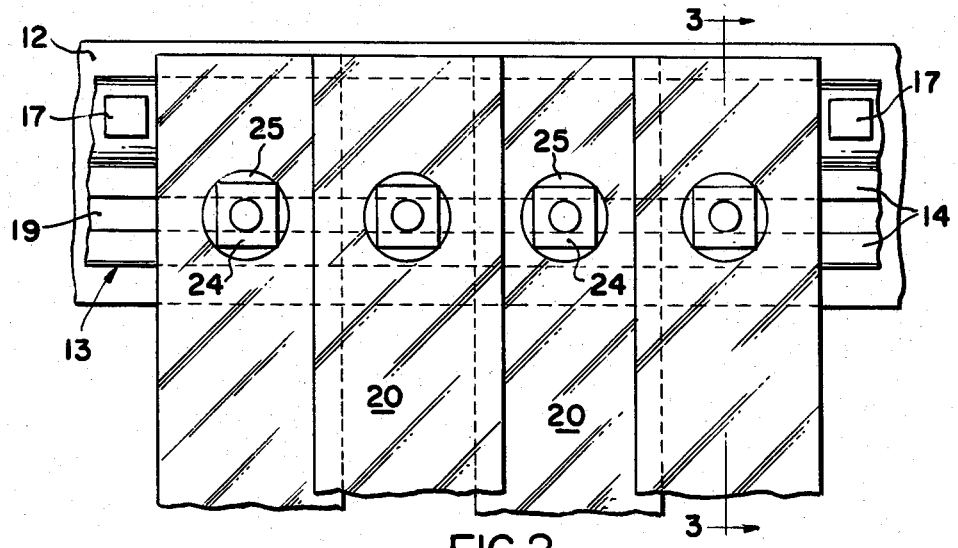
FIG. 2 is a greatly enlarged, fragmentary front elevational view of the upper end of the closure.

Referring now more particularly to the accompanying drawings, FIG. 1 discloses a flexible strip closure assembly, generally designated C, utilized to cover an opening O in a building where it is necessary, for instance, to penetrate the closure C and displace it to permit the passage of an automobile, a fork lift truck, or the like. For purposes of illustration, the building disclosed is illustrated as having a roof 10 and spaced apart wall portions 11, and, as FIG. 3 discloses, the upper end of the door opening O is defined by a top structural member 12.

The system of the present invention provides an aluminum extrusion, generally designated 13, which is cut to fit the space between walls 11, to function as a supporting header. The lower portion of extrusion 13 is provided with a flatted front wall bearing surface 14 which extends from end to end thereof, for a purpose which will be more particularly described later, and the upper portion is rearwardly inset as at 15 and is provided with spaced apart openings 16 permitting fastening members such as bolt and nut assemblies 17, to secure the header 13 in position on member 12.

Provided in the lower portion of the header strip 13, is a T slot generally designated T, which extends continuously from one end of the strip 13 to the other, and includes an inset enlarged slot portion 18 and a reduced slot portion 19 which opens out to the front wall bearing surface 14. Supported by and depending from the bearing surface 14, are a series of gravity maintained, relatively heavy gauge, flexible plastic strips 20, each of which is provided with a single, generally central, prepunched opening 21. The vertical strips 20 are provided in laterally overlapped relationship, and the degree of overlap may vary, from as much as 50% of the surface in eight inch material to lesser amounts when the strips 20 are wider. Typically the strips may be clear strips which transmit daylight when used as exterior doors, and may be termed relatively transparent. They may be formed, for example, from a tough polyvinyl chloride compound, capable of withstanding repeated impacts from vehicles and remaining flexible even in very low temperature conditions. Depending upon the particular use for the system, various strip widths such as eight, twelve and sixteen inches may be utilized, with narrower strips being used when pedestrian traffic is to penetrate the door while wider strips are utilized to withstand the impact from vehicles which are to normally penetrate the door.

Figure 3:
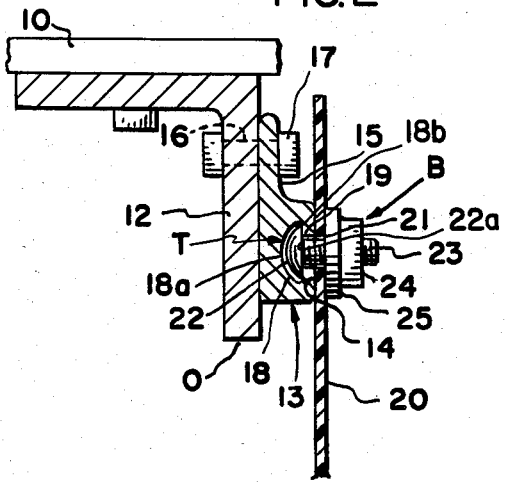
FIG. 3 a transverse, sectional view taken on the line 3—3 of FIG. 2.

The enlarged slot portion 18 of the T slot T in the header 13 is configured, as FIG. 3 discloses, to position and guide the curvilinear head 22 of a bolt B having a threaded shank 23 which extends out through the reduced slot portion 19 and through the opening 21 in a strip 20. The enlarged slot portion 18 of the T-slot T has a flat wall surface 18*b* parallel to the front wall bearing surface 14 and the head 22 of each bolt B has a mating flat wall 22*a*. A nut 24, threaded on each shank 23, bears against a washer 25 to draw each bolt head surface 22*a* into engagement with T-slot bearing surface 18*b* and securely clamp each strip 20 against bearing surface 14

THE OPERATION

In practice, with the T slots T open at their ends for ease of installation, the bolt assemblies may be preapplied to the plastic strips 20 and slipped endwisely into position after the header 13 is mounted and the strips 20 are cut to desired length. In preapplied condition, the nuts 24 will not be tightly clamped down and the curvilinear configuration of the enlarged slot portion 18 of the slot T will function to maintain the alignment of the strips as they are slid into the desired position. The curvilinear configuration 18*a* of the inner portion of the T slot is matched to the configuration of the heads of bolts B, to assist this endeavor. Thereafter, the strips 20 can be arranged in lapped relation to completely cover the opening O, and the nuts 24 can be tightened down to provide a secure clamp of the upper ends of the strips 20 against the bearing surface 14.

While the embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. In a flexible strip closure assembly for covering a door or like opening including, a longitudinally extending header adapted to be secured across the upper end of the door opening and a plurality of relatively elongate flexible strips of heavy gauge plastic or like material of relatively narrow width compared to their length hung from the header in vertical edge overlapped relationship such as to form a penetrable closure for the opening, the improvement wherein:

a. the header comprises an extrusion having a longitudinally continuous fixed flat front wall bearing surface and a longitudinally extending, longitudinally continuous, open-ended T-slot, defined by an inset enlarged slot portion spaced rearwardly from the front bearing surface and a reduced size slot portion opening through said bearing surface and extending rearwardly therefrom to said enlarged slot portion, the enlarged portion of the T-slot having a flat fixed, longitudinally continuous marginal wall bearing surface parallel to the front wall bearing surface;

b. the individual strips at their upper ends have a generally central opening therethrough opposite the reduced size slot portion;

c. an individual clamp for each strip, independent from said header and movable with respect thereto when unclamped, extends through the opening in the strip, and has an individual enlarged head received in the enlarged slot portion rearward of the said marginal wall bearing surface, with a shank extending out said reduced slot portion to pass through the opening in each strip, the said head having a flat front wall surface mated to the flat marginal wall bearing surface to clamp thereto;

d. a releasable securing means is on each shank, forwardly of each strip and bearing on the strip, to secure the individual strip in vertical position with its upper end pressed against said front wall bearing surface on the header and e. means spaced from said T-slot for securing the header in fixed position across the opening.

2. The invention set forth in claim 1 wherein each shank is threaded and the securing member comprises a nut threaded thereon to strip-clamping position.

3. The invention set forth in claim 2 wherein the enlarged portion of the T slot has an inner curvilinear wall extending from one end of the slot to the other and each head is curvilinearly matched to slide along it, and the header has a reduced thickness upper front wall portion inset from said bearing surface, with openings in the inset portion for securing the header in position.

* * * * *